US008360043B2

(12) United States Patent
Casas Salva

(10) Patent No.: US 8,360,043 B2
(45) Date of Patent: Jan. 29, 2013

(54) PUMP ACTION SPORTING AIR RIFLE

(75) Inventor: Francisco Casas Salva, Sant Boi de Llobregat (ES)

(73) Assignee: Gamo Outdoor, SL, Sant Boi de Llobregat (ES)

( * ) Notice: Subject to any disclaimer, the term of this patent is extended or adjusted under 35 U.S.C. 154(b) by 132 days.

(21) Appl. No.: 13/054,621

(22) PCT Filed: Jul. 28, 2008

(86) PCT No.: PCT/ES2008/070148

§ 371 (c)(1),
(2), (4) Date: Apr. 7, 2011

(87) PCT Pub. No.: WO2010/012846

PCT Pub. Date: Feb. 4, 2010

(65) Prior Publication Data

US 2011/0186027 A1 Aug. 4, 2011

(51) Int. Cl.
*F41B 11/00* (2006.01)

(52) U.S. Cl. ..... 124/74; 124/73; 124/72

(58) Field of Classification Search ..... 124/71–77
See application file for complete search history.

(56) References Cited

U.S. PATENT DOCUMENTS

| | | | | |
|---|---|---|---|---|
| 3,741,189 | A | 6/1973 | Kester et al. | |
| 2006/0266342 | A1 * | 11/2006 | Teipel et al. | 124/74 |
| 2011/0186027 | A1 * | 8/2011 | Casas Salva | 124/74 |

FOREIGN PATENT DOCUMENTS

| | | |
|---|---|---|
| EP | 1857765 | 11/2007 |
| ES | 8601452 | 2/1986 |
| ES | 2191508 | 9/2003 |
| GB | 2360570 | 11/2001 |

OTHER PUBLICATIONS

International Search Report for PCT/ES2008/070148 dated Jun. 9, 2009.

* cited by examiner

*Primary Examiner* — Samir Abdosh
(74) *Attorney, Agent, or Firm* — Nixon & Vanderhye P.C.

(57) ABSTRACT

Pump action sporting rifle comprising a barrel with sheath, bottle of compressed air or $CO_2$, a bottle hand-guard, a valve, a butt, a trigger, a trigger-guard, a safety catch, a hammer fixed to its disc, with said hammer facing the valve with an anti-fall safety device between the two, and a chassis that consists of a drag skid, a sliding rod joined by one of its ends to the drag skid and by the other to a slider device, the mentioned slider device consisting of an interior stop, an upper face supporting a tilting part with an upper arm that encloses a chamber.

16 Claims, 11 Drawing Sheets

PUMP ACTION SPORTING AIR RIFLE

This application is the U.S. national phase of International Application No. PCT/ES2008/070148, filed 28 Jul. 2008, which designated the U.S., the entire contents of which is hereby incorporated herein by reference.

Pump action sporting air rifle of the type comprising a barrel with sheath, bottle of compressed air or $CO_2$, a bottle hand-guard, a valve, a butt, a trigger, a trigger-guard, a safety catch, a hammer fixed to its disc, with said hammer facing the valve with an anti-fall safety device between the two, and a chassis that consists of a drag skid connected to the hand-guard and sheath, a sliding rod joined by one of its ends to the drag skid and by the other to a slider device, the mentioned slider device consisting of an interior stop, an upper face supporting a tilting part, an upper arm that encloses a chamber, a drum shaft, one of the ends of which passes through the centre of the drum, with the other positioned between the tilting part and the chamber, the referred drum has orifices for the chamber and a safety bolt in front of the hammer disc, which tilts and moves when the pressure from said disc disappears, thus the slider blocks said safety catch, so that on moving backward said hand-guard pulls the drag skid, moves the sliding rod which moves the slider backwards, also tilting the tilting part and chamber, rotating the drum to the next orifice and moving the hammer backwards through the action of a lower stop on the slider that pushes the hammer disc backwards, thus removing the pressure on the safety bolt which then moves and crosses, at least partially, the forward movement of the slider.

BACKGROUND OF THE INVENTION

The inventor is known in the sport carbine sector as a great innovator, especially in relation to compressed air and $CO_2$ carbines or pistols. Within this line of improvement, this patent refers to a pump action sporting air rifle.

Thus, Spanish patent No 0539503 (ES8601452) "Perfecting pneumatic firearms" D. Roy Hutchinson from 1985 is known, which refers to improvements in pneumatic firearms. It consists of a chamber with alternative movement for loading a projectile provided by a magazine in front of the chamber in a first chamber position that drives the projectile into the cartridge chamber when it is moved to a second position feeding the loaded projectile from air in a tank through a conduit in the chamber to fire the projectile from the firearm, with the chamber being returned to the first position in order to reload the firearm.

Spanish patent No 200001109 (ES2191508) "Removable pellet loading device in compressed air firearms" from 2000 is also known, from the actual applicant company, which refers to a removable pellet loading device in a compressed air firearm. It comprises a removable magazine with a casing that houses a rotating pellet-carrier drum with axial pass-through cavities for the pellets, retention means to individually maintain each of the said cavities aligned in turn with the barrel and a linearly-guided slider, cinematically linked to an oscillating traction part, fitted with an elastic traction tooth that can be coupled in turn into the mouths of said cavities by rotating the drum in a single direction. Said slider makes a first dragging movement and a second return movement to an initial position in the opposite direction, pushed by first and second protuberances of an oscillating actuator articulated to the firearm, which is moveable along one face of the barrel when folded and returned to a firing position.

BRIEF DISCLOSURE OF THE INVENTION

This invention is an improvement in the sector for compressed air or $CO_2$-based sport carbines.

The inventor has developed a series of improvements as described below.

It is a so-called "pump-action" sporting air rifle. It has the peculiarity that when the slider makes the backwards movement and then forwards, it loads all the mechanisms required to leave the firearm ready to be fired.

This means that with a single backward-forward movement of the slider, the sport carbine is ready for subsequent firing by the user.

The inventor has developed a safety bolt to make it impossible to load a second pellet after operating the slider and having loaded a first pellet, without having first fired thus first pellet, which is duly explained and described in the section on a specific exemplary embodiment of this invention.

This is achieved by a safety catch that is activated when the hammer moves backwards. Said safety catch blocks slider movement so that it cannot completely repeat the backward movement and hence load another pellet.

Moreover, the tilting part does not move, it only tilts, which allows drum rotation when the chamber is outside the drum (when the mentioned slider move backward) and said drum is blocked when the chamber (due to the forward movement of the slider) advances and is introduced into the drum and pushes one of the pellets into the barrel.

At the same time, it has two safety mechanisms in addition to the usual firing safety catch, which prevent accidental firing of the carbine. The first is positioned between the hammer and the valve and the second operates on the chamber.

The valve has also been improved, facilitating the blocking of the gas exit through it as well as its sealing.

It is an object of this invention, a pump action sporting air rifle comprising a barrel with sheath, bottle of compressed air or $CO_2$, a bottle hand-guard, a valve, a butt, a trigger, a trigger-guard, a safety catch, a hammer fixed to its disc, with said hammer facing the valve with an anti-fall safety device between the two, and a chassis characterised in that it consists of a drag skid connected to the hand-guard and sheath, a sliding rod joined by one of its ends to the drag skid and by the other to a slider device, the mentioned slider device consisting of an interior stop, an upper face supporting a tilting part, an upper arm that encloses a chamber, a drum shaft, one of the ends of which passes through the centre of the drum, with the other positioned between the tilting part and the chamber, the referred drum has orifices for the chamber and a safety bolt in front of the hammer disc, which tilts and moves when the pressure from said disc disappears, thus the slider blocks said safety catch, so that on moving backward, said hand-guard pulls the drag skid, moves the sliding rod which moves the slider backwards, also tilting the tilting part and chamber, rotating the drum to the next orifice and moving the hammer backwards through the action of a lower stop on the slider that pushes the hammer disc backwards, thus removing the pressure on the safety bolt which then moves and crosses, at least partially, the forward movement of the slider.

BRIEF DESCRIPTION OF THE DRAWINGS

In order to facilitate the description, the present report is accompanied by eleven sheets of drawings that show a practical case of exemplary embodiment, which is cited as a non-limiting example of the scope of the present invention.

A SPECIFIC EMBODIMENT EXAMPLE OF THIS INVENTION

Figure 1:
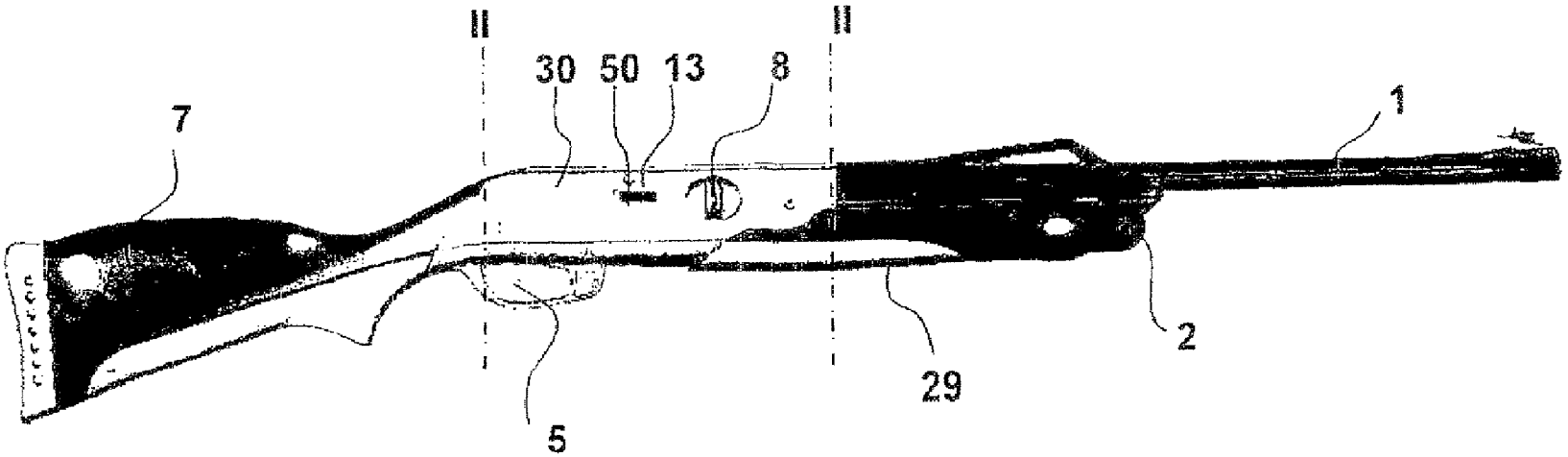
FIG. 1 is a view of the carbine that is the objective of this invention.

Thus, FIG. 1 illustrates a barrel 1, a gas bottle 2, a hand-guard 29, a butt 7, a chassis 30, a trigger 5, a drum 8 and an aperture 50, from which a drum shaft 13 protrudes.

Figure 2:
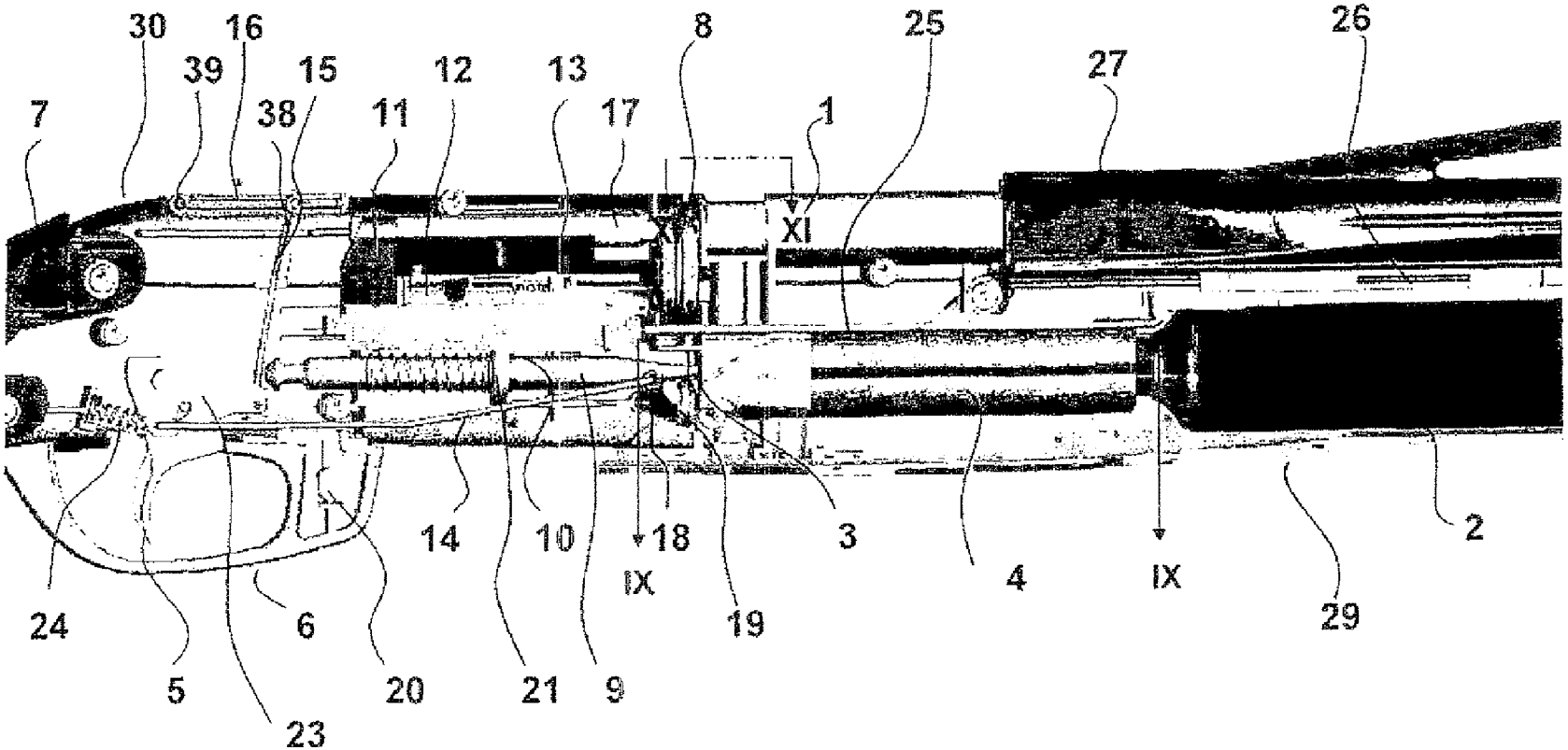
FIG. 2 is a longitudinal section through line II-II of FIG. 1, with a transparent effect of the hand-guard.

FIG. 2 shows the butt 7, the chassis 30, the hand-guard 29, the barrel, 1, with its sheath 27, the gas bottle 2, a drag skid 26, a valve 4 and its rod 3, a sliding rod 25, the drum 8, the drum shaft 13, a chamber 17, a tilting part 12, a slider 11, an anti-fall safety catch 19, a square 18, a hammer 9, with its disc 21, a safety bolt 10, the trigger 5, with its platens 23, its spring 24, and firing safety catch 20, a hand-guard 6, a stop 16, a first brace 14, a rotation point 38, tilting means 39 and a second brace 15.

Figure 3:
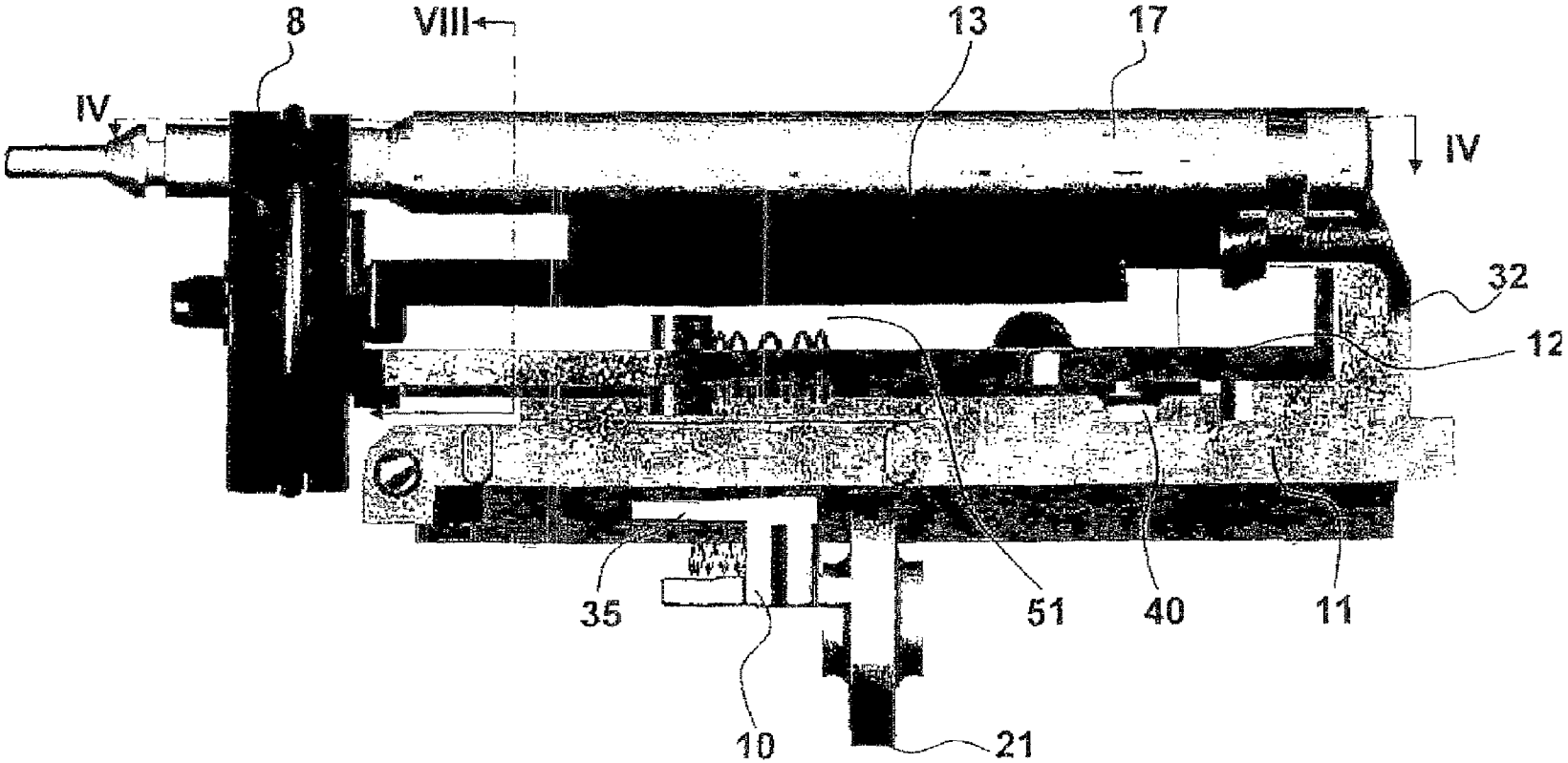
FIG. 3 is a view of the slider mechanism from the opposite side of that shown in FIG. 2.

FIG. 3 shows the chamber, 17, the drum 8, the drum shaft 13, the tilting part 12, with its lower stud 40 and its spring 51, the slider 11, with its upper arm 32, the hammer disc 21 and the safety bolt 10, with its upper platen 35.

Figure 4:
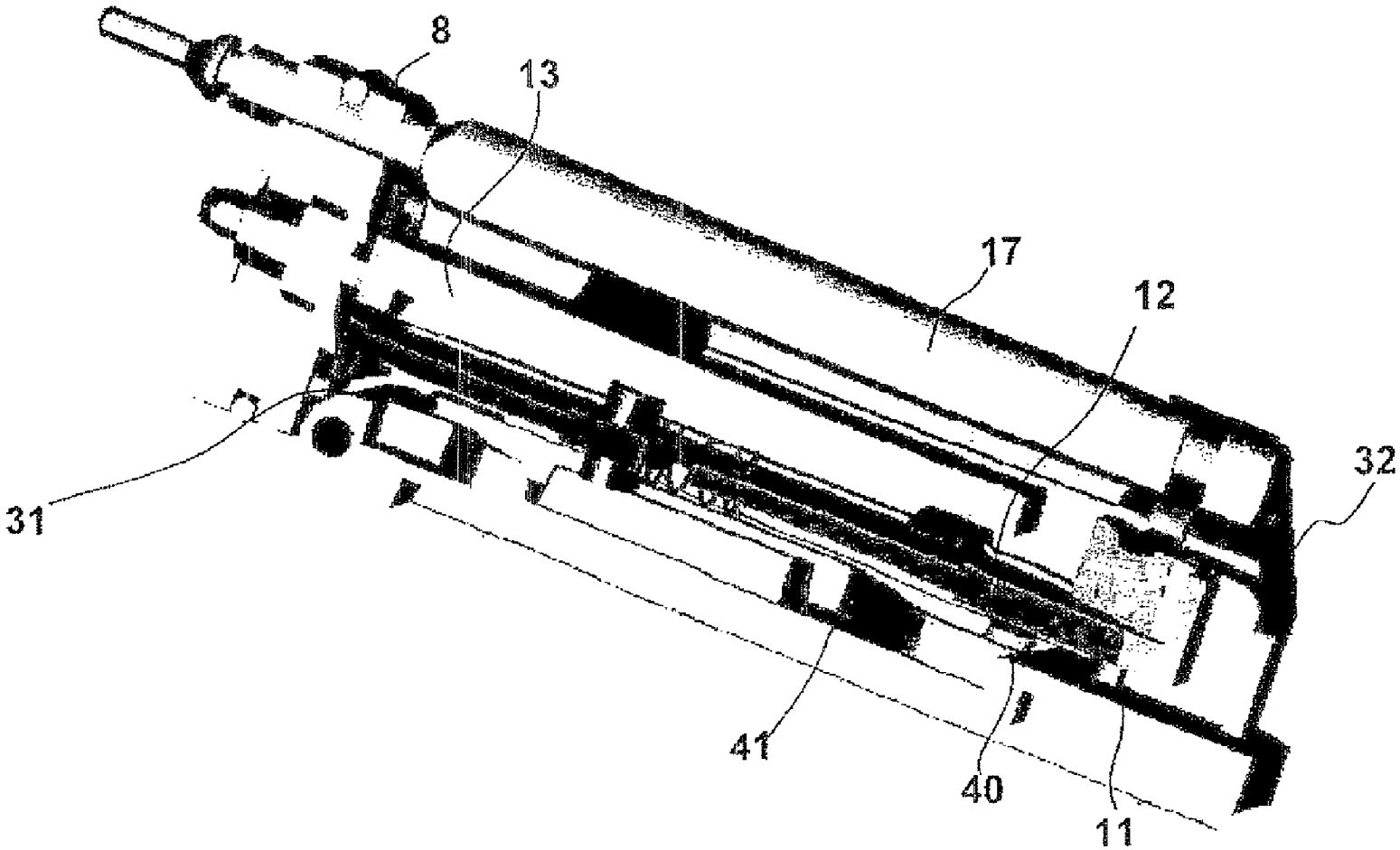
FIG. 4 is a section along line IV-IV of FIG. 3, with a certain inclination and eliminating certain lower elements and from the same side as FIG. 3.

FIG. 4 illustrates the chamber 17, the drum 8, the drum shaft 13, the tilting part 12, with its lower stud 40, the slider 11, with its upper face 31, its upper arm 32 and fluting 41.

Figure 5:
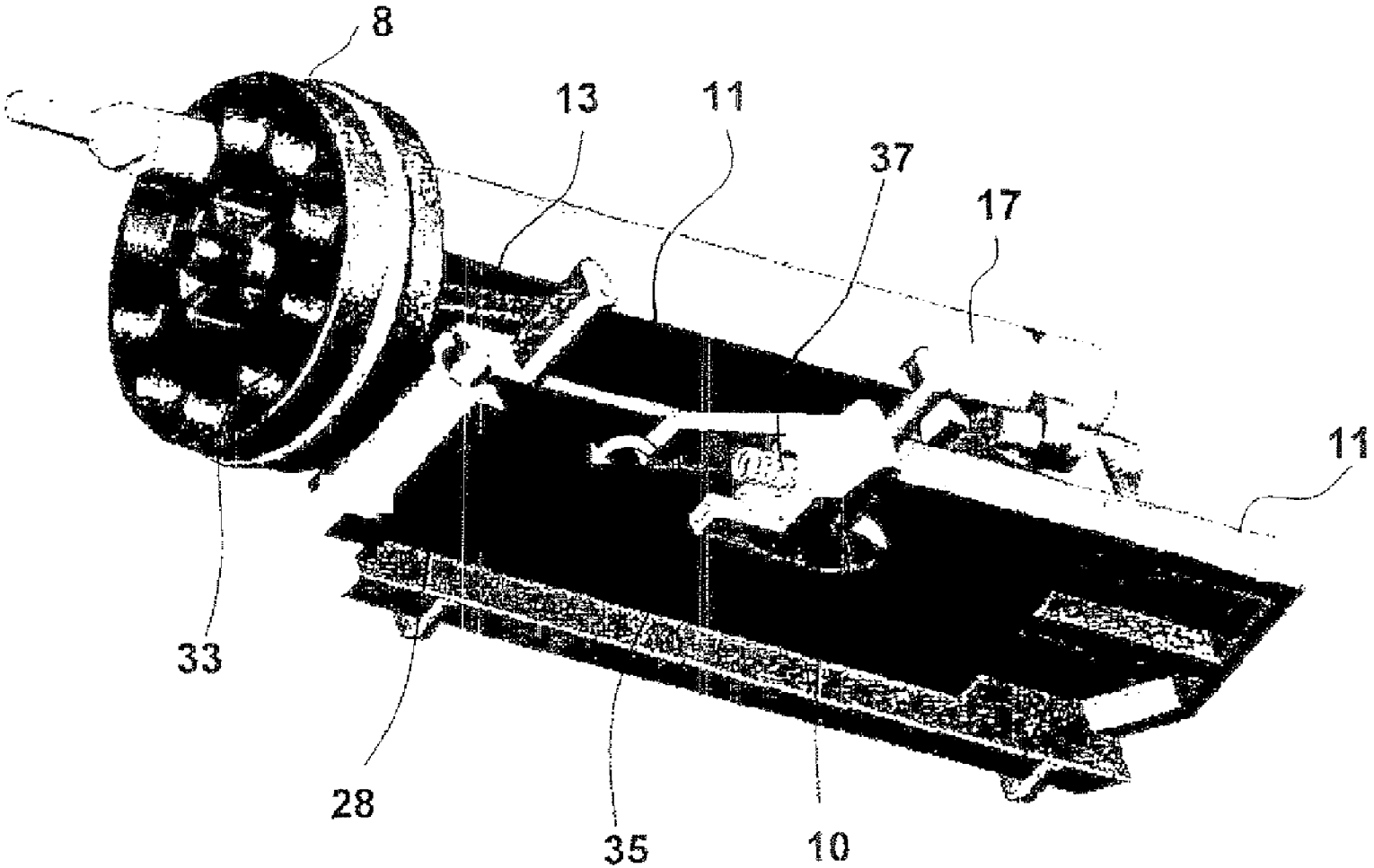
FIG. 5 is a perspective view from underneath FIG. 4, having eliminated the hammer disc and from the same side as FIG. 3.

Thus FIG. 5 illustrates the chamber 7, the drum 8, with its orifices 33, the drum shaft 13, the slider 11, with its lower stop 28, and the safety bolt 10, with its upper platen 35 and its spring 37.

Figure 6:
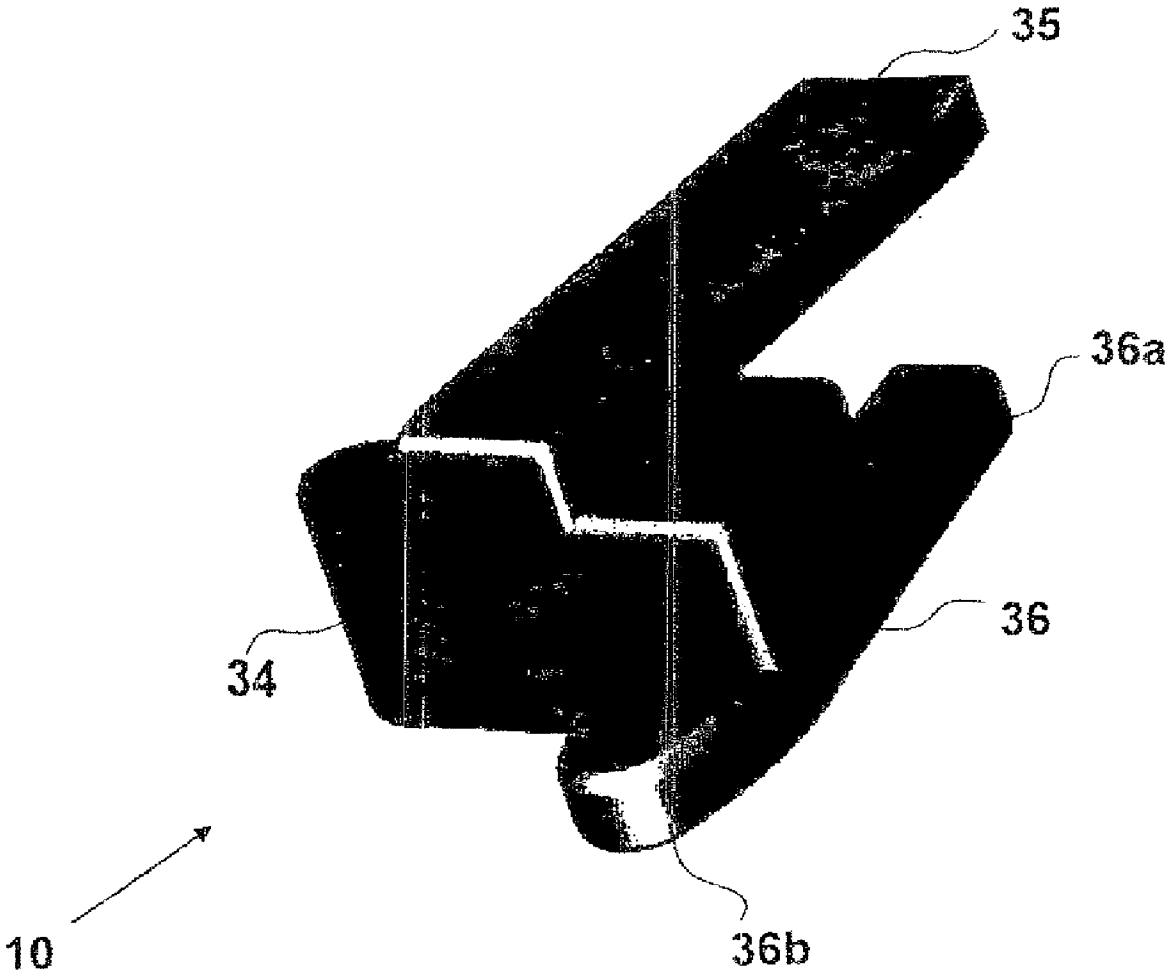
FIG. 6 is a perspective view of the safety bolt.

FIG. 6 shows the safety bolt 10, the upper platen 35, a safety catch body 34, a lower platen 36, with its front part 36*a* and rear part 36*b*.

Figure 7:
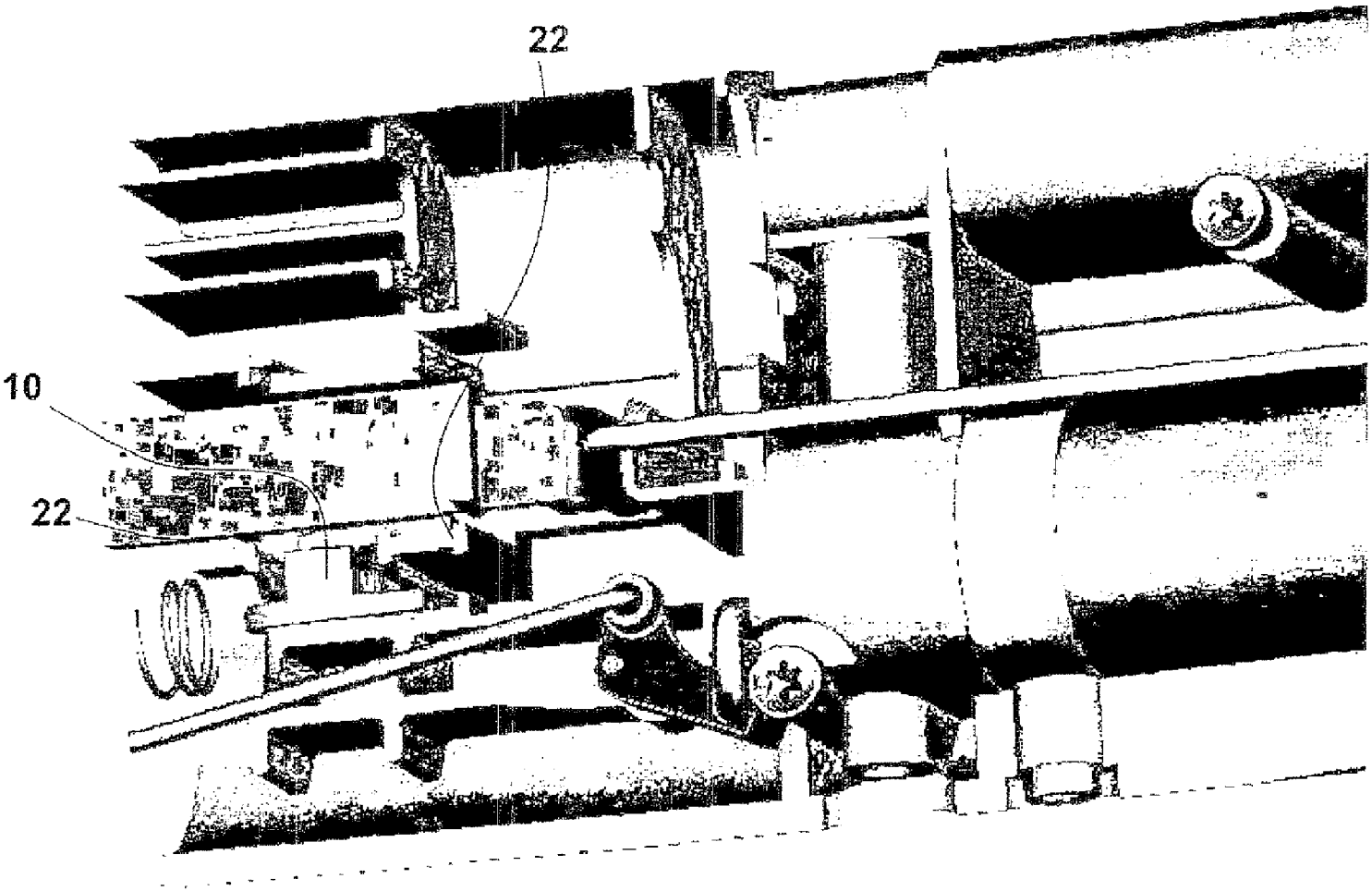
FIG. 7 is a view of the safety bolt on the firearm chassis, from the same side as FIG. 2.

FIG. 7 shows the safety bolt 10 between projections 22 of the firearm chassis.

Figure 8:
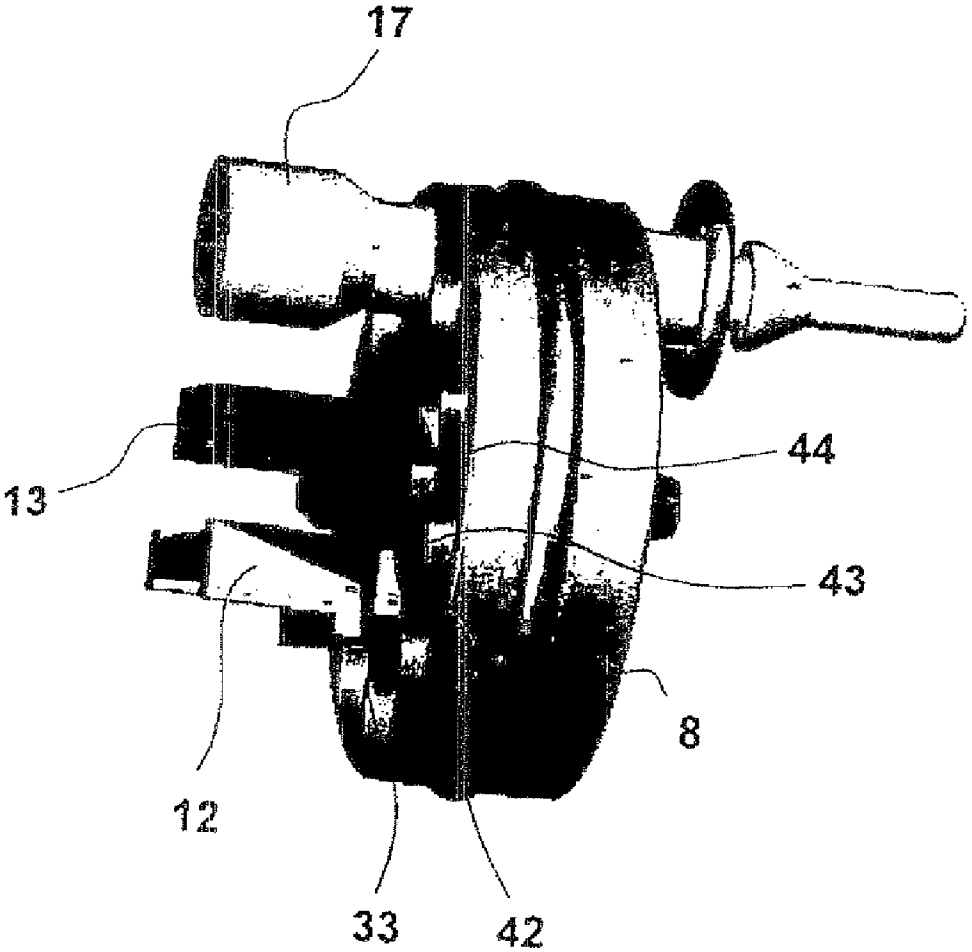
FIG. 8 is a section through line VIII-VIII of FIG. 3, after eliminating certain lower elements.

FIG. 8 illustrates the chamber 17, the drum 8, with its orifices 33, the drum shaft 13, the tilting part 12, with its protruding block 42, and protrusions 43, 44 belonging to the drum 8.

Figure 9:
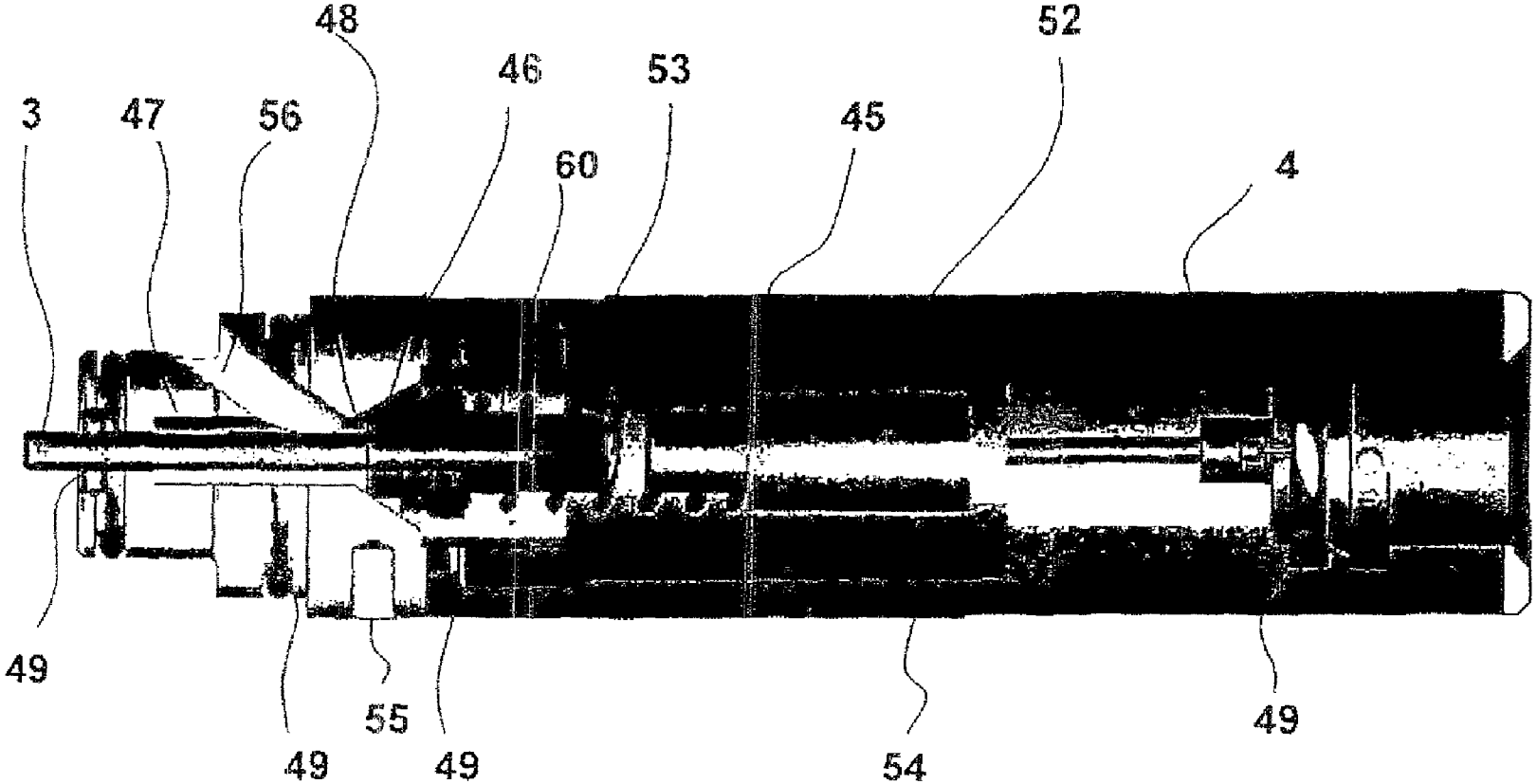
FIG. 9 is a section view through line IX-IX of FIG. 2.

FIG. 9 shows the valve 4, the valve rod 3, with its head 48, casing 60, a body 54, a head 55, a chamber 45, a conical part 46, a lane 47, O-rings 49, a spindle 52 and a conduit 56.

Figure 10:
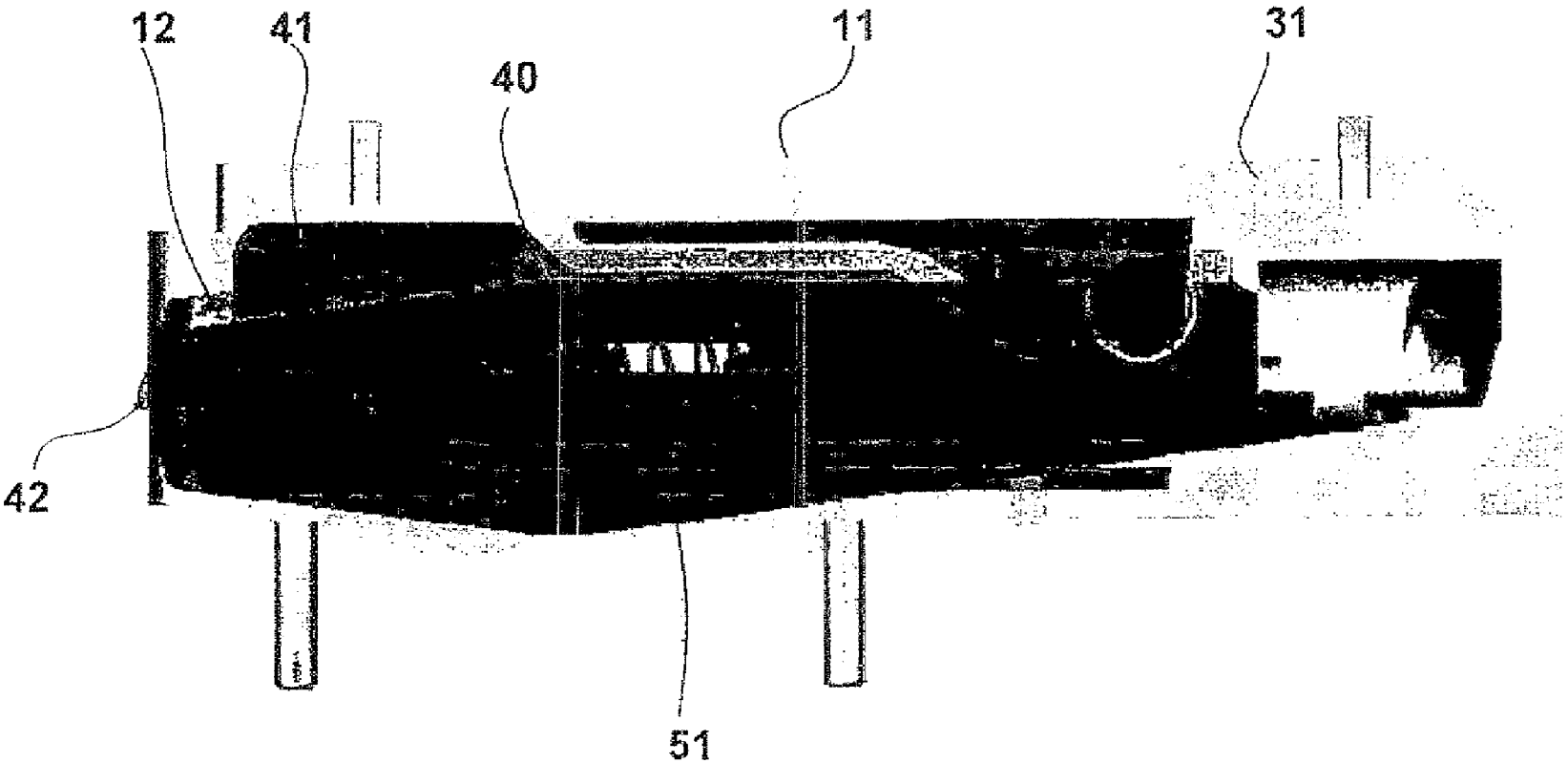
FIG. 10 is a plan view of the slider with a transparent tilting part.

FIG. 10 illustrates the upper side 31 of the slider 11, the fluting 41, the tilting part 12, the protruding block 42, the spring 51 and the lower stud 40.

Figure 11:
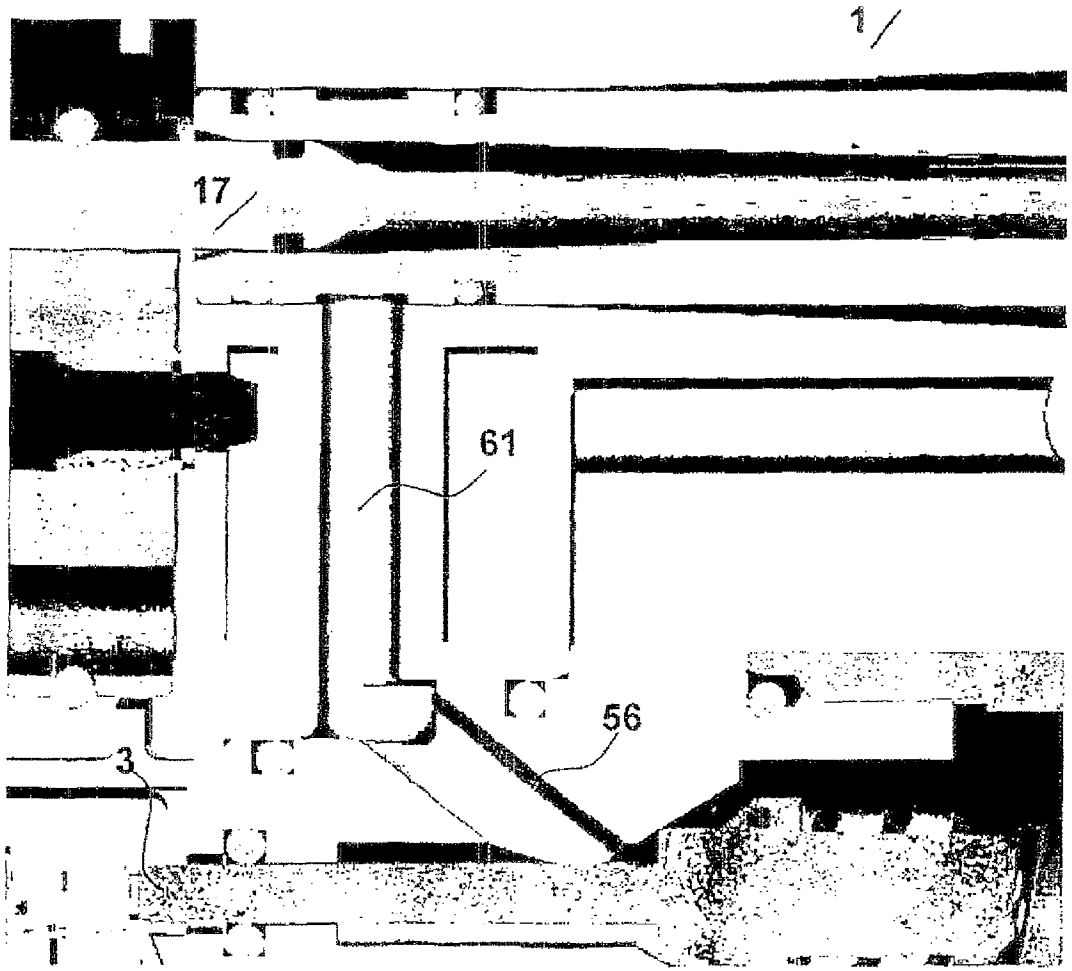
FIG. 11 is a transverse section view through line XI-XI of the area of valve connection with the barrel FIG. 2.

Lastly, FIG. 11 shows the barrel 1, the chamber 17, a conduit 61, the rod 3 and the conduit 56.

In this way, in a specific exemplary embodiment, the user places one of his hands gripping the hand-guard 29 and move its backwards (FIGS. 1 and 2).

On being dragged, the drag skid 26 moves slider 11 by means of slider rod 25, to which it is attached.

The backwards movement of the slider 11 results in several actions at the same time, which are described in greater detail below.

On the one hand, when slider 11 moves backwards by means of the lower stop 28, it drags the hammer disc 21, which is connected to the hammer 9 and moves this to the rear until it loads the trigger 5 between the trigger platens 23 where the head of the hammer 5 is anchored to an anchor point between said trigger platens 23.

On the other hand, when the hammer disc 21, which is behind the safety bolt 10, moves backwards the pressure on said safety bolt 10 and its spring 37 is removed.

Thus, spring 37 is decompressed and moves the safety catch 10 backwards, causing it to move upwards and rotate at the same time, with said movement limited by chassis 30 prolongations 22, leaving the upper platen 35 crosswise, blocking, at least partially, the passage of the lower stop 28 of slider 11 (FIGS. 3, 5, 6 and 7).

Blocking the return of lower stop 28 prevents slider 11 from repeating all these movements and reloading a new pellet (no shown) in the barrel 1.

Safety bolt 10 is supported on chassis 30 and projections 22 of said chassis 30. This configuration is intended to limit the movements of said safety bolt 10 due to the fact that these movements are vary fast due to the hammer disc 21 pressure or lack thereof (FIG. 7).

The previously indicated safety bolt 10 comprises a body 34, onto which the hammer disc 21 pushes, a spring 37, supported on the body 34 and on the chassis 30 or a projection 22, the compression or decompression of which produces the movement of the safety bolt 10, with an upper platen 35, which is the one the remains crosswise blocking slider 11 movement and a lower platen 36 (FIG. 6).

In this exemplary embodiment, the upper platen 35 is oblique with respect to the lower one 36 and to the direction of slider 11 movement in order to facilitate the blocking movement. Moreover, the lower platen 36 comprises a forward projection 36*a* from the body and a backward projection 36*b* from the body to enhance the fitting of projections 22 from the chassis 30.

The backwards movement of slider 11 also affects the loading of the pellet into the barrel 1. This is so that slider 11 drags the chamber 17 when it makes the referred movement because the slider upper arm 32 is fixed to the chamber 17 by the front end, so that when arm 32 moves backwards, chamber 17 also moves backwards outside drum 8.

Said backwards movement of slider 11 determines a tilting movement of tilting part 12. This is produced because the tilting part comprises a lower stud 40 that is inside fluting 41 belonging to the slider 11 (FIGS. 3, 4 and 10), which define a given path in the form of two "S" on their sides, or double curves, with identical starts and finishes, but different intermediate zones or routes, located on the upper face 31 of slider 11, with a final end of travel so that when the slider moves backwards, tilting part 12 makes a tilting movement, not one of translation and the front end of the tilting part, in contact with drum 8, rotates aid drum 8 as described in greater detail below.

Initially, the front end of the tilting part 12 configures a protruding block 42 that immobilises drum 8, fitting between the projections 43, 44 in the form of a wedge or gear and leaving said protruding block 42 immobilised, this immobilising drum 8 also.

The previously indicated movement of tilting part 12 causes the protruding block 42 to push on one of the projections 43 and making the drum 8 rotate. It should be remembered (as pointed out in previous paragraphs) that, at this moment chamber 17 is outside drum 8, so that drum 8 is free to rotate.

When the tilting part reaches the end of the "S" the protruding block 42 no longer pushes projection 43 and stops, the drum 8 also stops rotating.

Once the backwards movement of the hand-guard 29 stops, the user performs the same operation, but this time in a forward direction.

On being dragged, the drag skid 26 moves slider 11 in the opposite direction to the previous one, by means of slider rod 25, to which it is attached.

The subsequent forward movement of slider 11 forces tilting part 12 to execute the return movement to its initial position.

By means of its lower stud 40, tilting part 12 will take the other "S" route or intermediate zone, which is different to the one it followed when slider 11 moved backwards. It is necessary that even when it appears that tilting part 12 is being moved by slider 11, tilting part 12 is held in practically the same position and it is slider 11 that moves and the route adopted by said lower stud 40 of the tilting part is that which determines the tilting movement of tilting part 12.

At the same time, with the advance movement of slider 11, chamber 17 enters drum 8 through orifice 33, blocking said drum 8 because chamber 17, as previously described, is connected to slider 11 by upper arm 32.

Prior to blocking said drum 8, drum orifice 33, which contains a pellet, is facing the point of chamber 17. Chamber 17, dragged by slider 11, pushes said pellet through orifice 33 and locates inside the barrel 1.

When drum 8 is blocked by chamber 17, tilting part 12 moves the protruding block 42 raises it by projection 43 in a wedge or gear as if it were a pawl and jumps the following projection 44.

When the protruding block 42 ends its travel by the wedge of projection 43, it falls between two projections, the one it has just climbed over 43 and the one immediately behind it 44 and again blocks the drum 8.

Spring 51 of tilting part 12 has a very specific function. Tilting part 12 is also partially blocked by projections from chassis 30.

The tilting movement of tilting part 12 requires a point that allows all movement to be absorbed without moving tilting part 12 just when protruding block 42 is raised by the wedge or gear of projection 43 until it falls in front of projection 44 (the next one it will push) since said drum 8 is blocked by chamber 17.

In all these movements, the only element that does not move id drum shaft 13, which crosses the centre of drum 8 by one of its ends and the other is positioned between the tilting part 12 and chamber 17.

If a new pellet is attempted to be loaded, safety catch 10 will block lower stop 28 by means of upper platen 35 and which will prevent slider 11 from completing all its movement and hence another pellet cannot be loaded into barrel 1.

Once firing safety catch 20 is released on pressing trigger 5, the hammer 9 is released and, at the same time, the anti-fall safety catch 19 is located between valve rod 3 and the point of hammer 9, thanks to the second brace 15 which communicates the trigger 5 with square 18 and the latter with the anti-fall safety catch 19 so that hammer 9 can strike the valve rod 3 and thus release compressed air or $CO_2$ in the direction of barrel 1.

The anti-fall safety catch 19 occupies a space equivalent to the separation between hammer 19 and valve 3 rod. This is arranged like this so that if the carbine accidentally falls, hammer 9 will be released without trigger 5 having been pressed, hammer 9 cannot strike the valve 3 rod and, in this way, the carbine cannot fire.

When the rod of valve 3 is pressed by hammer 9 striking anti-fall safety catch 19, said rod 3 is pushed inside and allows the gas to exit through conduit 56 and from there it is taken by conduit 61 to barrel 1 where it meets the pellet and pushes it at high speed out of barrel 1.

Conduit 56 (FIG. 9) is inclined in the direction of advance of the compressed air or $CO_2$, thus facilitating its exit, communicating passage 47 with conduit 61, which transfers the compressed air or $CO_2$ towards barrel 1.

When the pressure on rod 3 is removed by spring 53, the head 48 of rod 3 plugs the conical form 46 of chamber 45, which cuts off the compressed air or $CO_2$, to conduit 56. Head 48 is made of a rigid synthetic material that seals off chamber 45 in an optimum fashion.

Valve 4 comprises, at least, a body 54 and a head 55, which are fixed together, for example, by a screw thread.

Similarly, inside head 55 is chamber 45, one end 46 of which is conical and this ends in a passage 47, both of which belong to head 55. Inside said chamber 45 is the rod of valve 3, which crosses head 55, providing said rod 3 with a rocking motion, with a head 48, with conical end 46 covering said head 48 in the rest position.

One end of spring 53 covers, at least partially, spindle 52 and the other end of spring 53 covers, at least partially, casing 60, made of, for example plastic, which partially protects rod 3 or an extension of same.

An anti-return mechanism is proposed for chamber 17 that prevents the compressed air or $CO_2$ pressure from moving chamber 17 backwards.

Thus, when trigger 5 is operated, the pulls on a first brace 14 causing a stop 16 to move downwards, which by means of a rotation point 38 situated alongside said stop 16 and a tilting mean 39 situated at the opposite end to that facing chamber 17, which is joined to chassis 30 so that if the chamber had a recoil backwards, it would find its advance blocked by stop 16 which would prevent any backwards movement.

When hammer 9 moves forward it strikes safety catch 10 by means of disc 21, leaving safety catch 10 in the blocking position.

In order the change drum 8 now empty of pellets (FIG. 1), drum shaft 13 is moved backwards inside aperture 50 until it reaches the end-of-travel stop. On reaching said end, the point of drum shaft 13, which was initially crosswise in drum 8, moves backwards along the complete drum shaft, it is no longer crosswise in mentioned drum 8 and this can be removed from the firearm without any difficulty.

This invention patent describes a new pump action sporting air rifle. The examples described here do not limit the present invention and it may have various applications and/or adaptations, all of which are within the scope of the following claims.

The invention claimed is:

1. A pump action sporting air rifle of the type comprising a barrel (1) with sheath (27), bottle (2) of compressed air or CO2, a bottle hand-guard (29), a valve (4), a butt (7), a trigger (5), a trigger-guard (6), a safety catch (20), a hammer (9) fixed to its disc (21) with said hammer (9) facing the valve (4) with an anti-fall safety device (19) between the two, and a chassis (30) characterised in that it comprises:

a drag skid (26) connected to the hand-guard (6) and sheath (27), a sliding rod (25) joined by one of its ends to the drag skid (26) and by the other to a slider device (11), the mentioned slider device (11) consisting of an interior stop (28), an upper face (31) supporting a tilting part (12), an upper arm (32) that encloses a chamber (7), a drum shaft (13), one of the ends of which passes through the centre of the drum (8), with the other positioned between the tilting part (12) and the chamber (7), the referred drum (8) has orifices (33) for allowing the chamber to pass through, and a safety bolt (10) in front of the hammer disc (21), which tilts and moves when the pressure from said disc (21) disappears, thus the slider (11) blocks said safety bolt (10), so that on moving backward, said hand-guard (29) pulls the drag skid (26), moves the sliding rod (25) which moves the slider (11) backwards, also tilting the tilting part (12) and chamber (17), rotating the drum (8) to the next orifice (33) and moving the hammer (9) backwards through the action of a lower stop (28) on the slider (11) that pushes the hammer disc (21) backwards, thus removing the pressure on the safety bolt (10) which then moves and crosses, at least partially, the forward movement of the slider (11).

2. An air rifle in accordance with claim 1 characterised in that safety bolt (10) is supported on chassis (30) and projections (22) of said chassis (30).

3. An air rifle in accordance with claim 2 characterised in that referred safety bolt (10) comprises a body (34), a spring (37), supported on body (34) and on chassis (30) or a projection (22), with an upper platen (35) and a lower platen (36).

4. An air rifle in accordance with claim 3 characterised in that the upper platen (34) is oblique with respect to the lower one (36) and comprises a forward projection (36*a*) from the body and a backward projection (36*b*) from the body.

5. An air rifle in accordance with claim 1 characterised in that comprises an anti-return mechanism for the chamber (17).

6. An air rifle in accordance with claim 5 characterised in that said mechanism comprises a tilting stop (16), with one end connected to the chassis (30) by first tilting means (39), with the other end free and similarly connected to the trigger (23) by a first brace (14) that connects said trigger (23) to a point (38), also tilting, located along the length of the said stop (16).

7. An air rifle in accordance with claim 1 characterised in that the tilting part (12) comprises a lower stud (40) over fluting (41) on the upper face (31) of the slider (11).

8. An air rifle in accordance with claim 7 characterised in that a protruding block (42) is configured at the front end of the tilting part (12) which, in the rest position, immobilises drum (8) and chamber (17), fitting between two projections (43, 44) in the form of a wedge or gear and, in the active position, pushes one of the two projections (43) causing the drum 8 to rotate.

9. An air rifle in accordance with claim 8 characterised in that the tilting part (12) comprises a spring (51) inside that is supported on a projection from the chassis that compresses said spring (51) when the tilting part commences its return movement.

10. An air rifle in accordance with claim 7 characterised in that the fluting (41) defines a given path in the form of two "S" on their sides, or double curves, with identical starts and finishes, but different intermediate zones or routes, located on the upper face (31) of slider (11).

11. An air rifle in accordance with claim 1 characterised in that valve (4) contains chamber (45), one end (46) of which is conical and this ends in a passage (47), inside said chamber (45) is a rod (3), with rocking motion, with a head (48), with said head (48) of the valve in the rest position covering the conical end (46).

12. An air rifle in accordance with claim 11 characterised in that head (48) is made of a rigid synthetic material.

13. An air rifle in accordance with claim 11 characterised in that the inside of the chamber also comprises a spring (53), one end of which covers, at least partially, spindle (52) and the other end of spring (53) covers, at least partially, casing (60), which partially protects rod (3) or an extension of same.

14. An air rifle in accordance with claim 13 characterised in that the valve is made up of, at least, a body (54) and a head (55) that are fixed one on the other.

15. An air rifle in accordance with claim 14 characterised in that head (55) comprises a conduit (56) that communicates passage (47) that is inclined in the direction of advance of the compressed air or CO2, with conduit that transfers the compressed air or CO2 towards barrel (1).

16. An air rifle in accordance with claim 1 characterised in that drum shaft (13):

has longitudinal movement, is accessible from the outside through an aperture (50) made in the chassis (30), and comprises guide means, located inside the chassis (30) that guide the longitudinal movement of the drum shaft (13).

* * * * *